US006987500B2

(12) United States Patent
Morita et al.

(10) Patent No.: US 6,987,500 B2
(45) Date of Patent: Jan. 17, 2006

(54) LIQUID CRYSTAL DISPLAY AND SIGNAL CORRECTING CIRCUIT THEREFOR

(75) Inventors: Toshiyuki Morita, Tokyo (JP); Shinichi Nishida, Tokyo (JP)

(73) Assignee: NEC LCD Technologies, Ltd., Kanagawa (JP)

( * ) Notice: Subject to any disclaimer, the term of this patent is extended or adjusted under 35 U.S.C. 154(b) by 333 days.

(21) Appl. No.: 10/357,385

(22) Filed: Feb. 4, 2003

(65) Prior Publication Data

US 2003/0146892 A1 Aug. 7, 2003

(30) Foreign Application Priority Data

Feb. 6, 2002 (JP) ..... 2002-030181

(51) Int. Cl.
*G09G 3/36* (2006.01)
*G09G 5/00* (2006.01)

(52) U.S. Cl. ..... 345/96; 345/209

(58) Field of Classification Search ..... 345/94, 345/95, 96, 208, 209
See application file for complete search history.

(56) References Cited

U.S. PATENT DOCUMENTS 5,528,257 A * 6/1996 Okumura et al. ..... 345/99
5,841,410 A * 11/1998 Oda et al. ..... 345/58
6,040,814 A * 3/2000 Murakami et al. ..... 345/94
2002/0044123 A1 * 4/2002 Aoki ..... 345/89

FOREIGN PATENT DOCUMENTS

| | | |
|---|---|---|
| JP | 2-92174 | 3/1990 |
| JP | 3-96993 | 4/1991 |
| JP | 3-96696 | 10/1991 |
| JP | 5-219461 | * 8/1993 |
| JP | 07-159786 | 6/1995 |
| JP | 7-159786 | 6/1995 |
| JP | 9-311668 | * 12/1997 |
| JP | 11-119743 | * 4/1999 |
| JP | 2001-174784 | 6/2001 |
| KR | 2000-0074549 | 12/2000 |
| KR | 2001-0042127 | 5/2001 |
| WO | WO 99/54865 | 10/1999 |

* cited by examiner

*Primary Examiner*—Ryan Yang
(74) *Attorney, Agent, or Firm*—McGinn IP Law Group, PLLC

(57) ABSTRACT

A signal correcting circuit, which adds a correction value generated based on a signal stored in a frame memory to an input signal and outputs a resultant signal, is used to correct image data which is an input signal to a liquid crystal display to thereby completely compensate for the influence of the asymmetry of the input signal on the liquid crystal display. This prevents generation of residual images and flickering of the screen.

6 Claims, 7 Drawing Sheets

LIQUID CRYSTAL DISPLAY AND SIGNAL CORRECTING CIRCUIT THEREFOR

BACKGROUND OF THE INVENTION

1. Field of the Invention

The present invention relates to a liquid crystal display and a signal correcting circuit therefor, and, more particularly, to an active matrix type liquid crystal display and a signal correcting circuit therefor.

2. Description of the Related Art

Conventional liquid crystal displays suffer generation of residual images at the time of displaying moving pictures because the response speeds have not reached the level that matches with the display of TV images. In particular, an in-plane switching (IPS) active matrix type liquid crystal display is disadvantageously likely to generate residual images.

To prevent such image persistence, many conventional IPS liquid crystal displays use a so-called low-resistant liquid crystal whose material has a reduced specific resistance (see Japanese Patent Laid-Open No. 159786/1995). While the response of this conventional IPS liquid crystal display that uses a low-resistant liquid crystal is improved by reducing the specific resistance of the liquid crystal material, a voltage is applied to the liquid crystal panel without correcting image signals.

In case where an image with high contrast should move within the screen, however, only a unidirectional electric field would be generated between the pixel electrodes of such a conventional liquid crystal display. This caused concentration of charges only on one of the pixel electrodes which are opposing each other. This charge concentration brought about display problems, such as generation of residual images and flickering of the screen.

Referring now to FIGS. 1A to 1C and 2, the cause for the concentration and storage of charges only on one of the pixel electrodes which are opposing each other will be described below. FIG. 1A shows how, for example, a monochromatic vertical stripe image having high contrast moves across the background of an intermediate tone. In case where white and black portions of such an image move rightward frame by frame (a time unit in which all the pixels that constitute one screen of the display panel are scanned) as shown in FIG. 1B, a voltage to be applied to the liquid crystal frame by frame becomes as shown in FIG. 1C. In FIG. 1C, (1) to (5) indicate display positions in which the image moves rightward frame by frame.

FIG. 2 shows the behavior of an electric field between the pixel electrodes (the pixel electrode and the opposing electrode opposing to said pixel electrode) and when the voltage as shown in FIG. 1C is applied to the liquid crystal. In the frames (1) and (3), the voltage on the pixel electrode is higher than the voltage on the opposing electrode, so that charges are concentrated only on the pixel electrode and are stored there. Because an electric field is not generated in each of the frames (2) and (4), however, charges are not stored. Although an electric field is generated after the frame (5), the direction of the electric field is reversed symmetrically frame by frame, so that charges are not stored. As a result, the charges stored in the pixel electrode in the frames (1) to (5) influence the display while they are diffused, thus causing undesirable generation of residual images and flickering of the screen.

SUMMARY OF THE INVENTION

Accordingly, it is an object of the invention to provide a liquid crystal display and a signal correcting circuit therefor, which inhibit charges from being concentrated only on one of the pixel electrode and from being stored there even in case where an image with high contrast moves within the screen, thereby preventing display problems, such as generation of residual images and flickering of the screen.

A signal correcting circuit for a liquid crystal display according to the present invention comprises a polarity determining section for determining from an input signal whether a voltage applied to a liquid crystal has a positive polarity or a negative polarity; a sign appending section for appending a positive or negative signal to the input signal in accordance with a decision made by the polarity determining section; a frame memory; a first multiplier for multiplying data stored in the frame memory by a first constant; a first adder for adding a signal to which the positive or negative sign is appended by the sign appending section to an output signal from the first multiplier and outputting a resultant signal to the frame memory; a second multiplier for multiplying data stored in the frame memory by a second constant; a second adder for adding an output signal from the sign appending section to an output signal from the second multiplier; and an absolute value acquiring section for removing a positive or negative sign from an output signal from the second adder and outputting a resultant signal as an absolute value.

In the signal correcting circuit, the first constant may be set to a ratio at which charges stored in the liquid crystal display remain after one frame period, and the second constant may be set to the amount of charges moved between electrodes.

A liquid crystal display according to the present invention uses an output signal from an absolute value acquiring section of a signal correcting circuit as input signal to a liquid crystal display section having display pixels laid out in a matrix form. Said signal correcting circuit comprises a polarity determining section for determining from an input signal whether a voltage applied to a liquid crystal has a positive polarity or a negative polarity; a sign appending section for appending a positive or negative signal to the input signal in accordance with a decision made by the polarity determining section; a frame memory; a first multiplier for multiplying data stored in the frame memory by a first constant; a first adder for adding a signal to which the positive or negative sign is appended by the sign appending section to an output signal from the first multiplier and outputting a resultant signal to the frame memory; a second multiplier for multiplying data stored in the frame memory by a second constant; and a second adder for adding an output signal from the sign appending section to an output signal from the second multiplier. The absolute value acquiring section removes a positive or negative sign from an output signal from the second adder and outputting a resultant signal as an absolute value.

The liquid crystal display may comprise a controller for outputting image data and a horizontal sync signal based on an input signal externally supplied; a source driver for supplying the image data output from the controller to the liquid crystal display section; and a gate driver for sequentially enabling the display pixels of the liquid crystal display section in synchronism with the horizontal sync signal output from the controller. The signal correcting circuit is provided between the controller and the source driver for correcting the image data.

DETAILED DESCRIPTION OF THE PREFERRED EMBODIMENTS

Figure 1A:
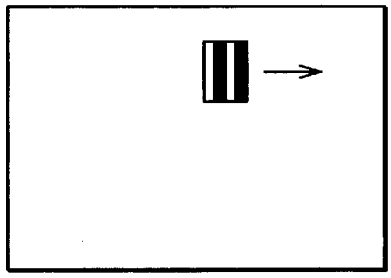
FIG. 1A (PRIOR ART)
FIG. 1A shows how an image having high contrast moves across the screen.
Figure 1B:
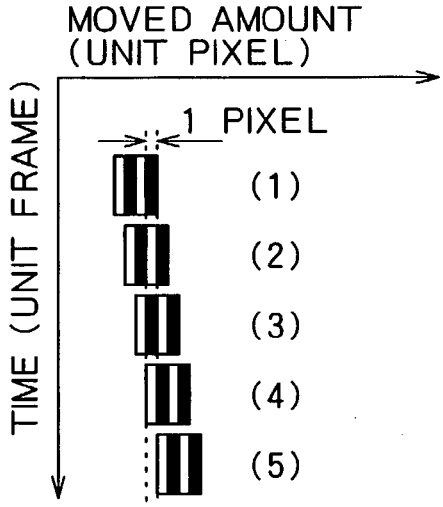
FIG. 1B (PRIOR ART)
FIG. 1B shows how an image having white and black portions moves frame by frame.
Figure 1C:
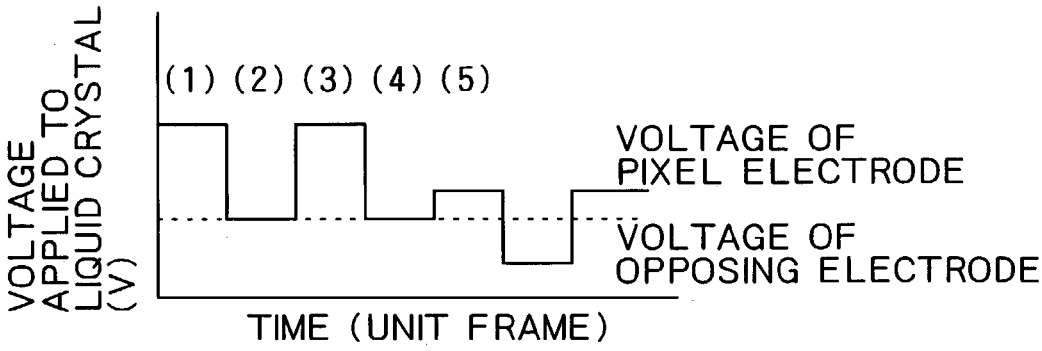
FIG. 1C (PRIOR ART)
FIG. 1C shows a voltage to be applied to the liquid crystal frame by frame.
Figure 2:
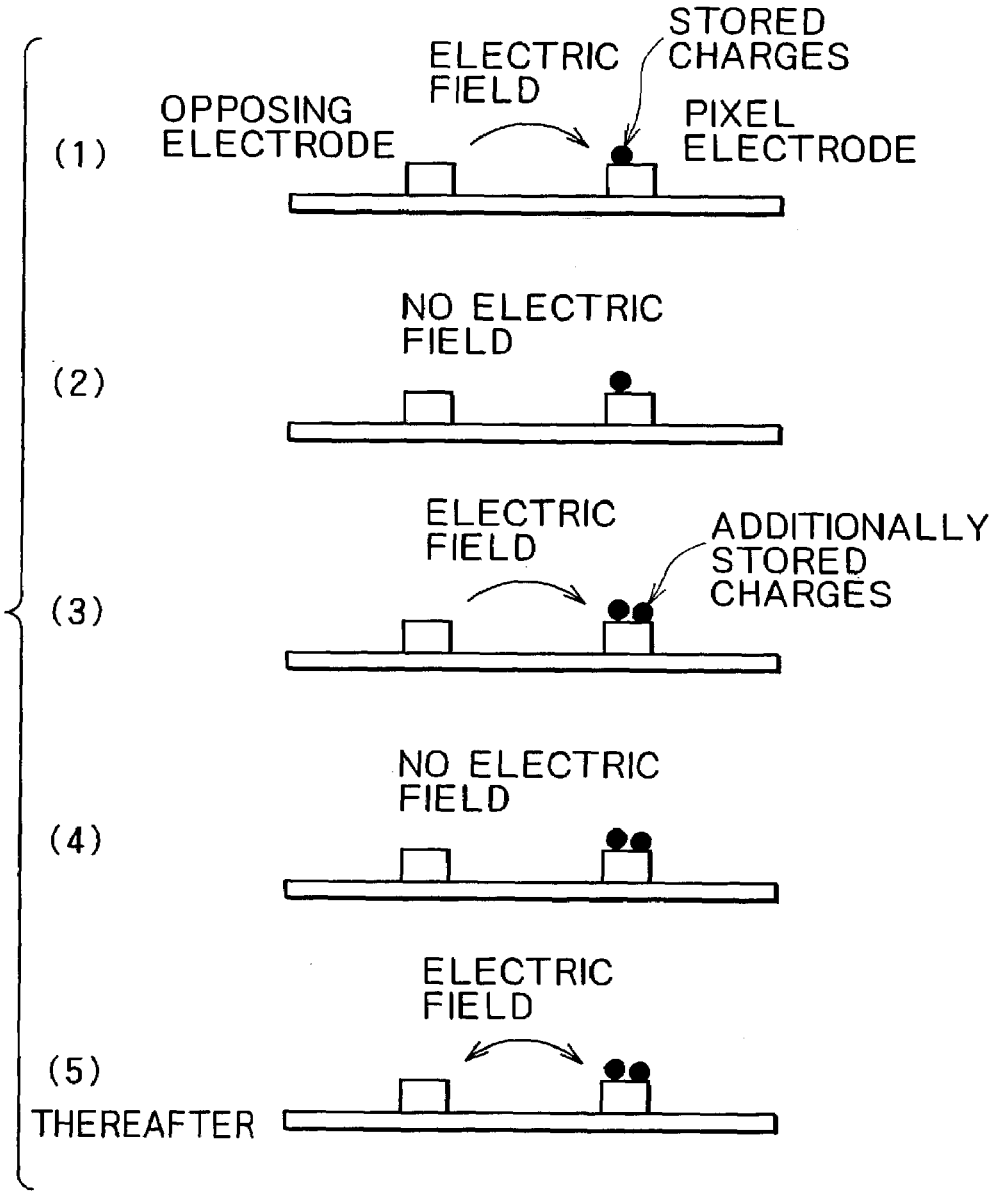
FIG. 2 (PRIOR ART)
FIG. 2 shows the behavior of an electric field between an opposing electrode and a pixel electrode when the voltage as shown in FIG. 1C is applied to the liquid crystal.
Figure 3:
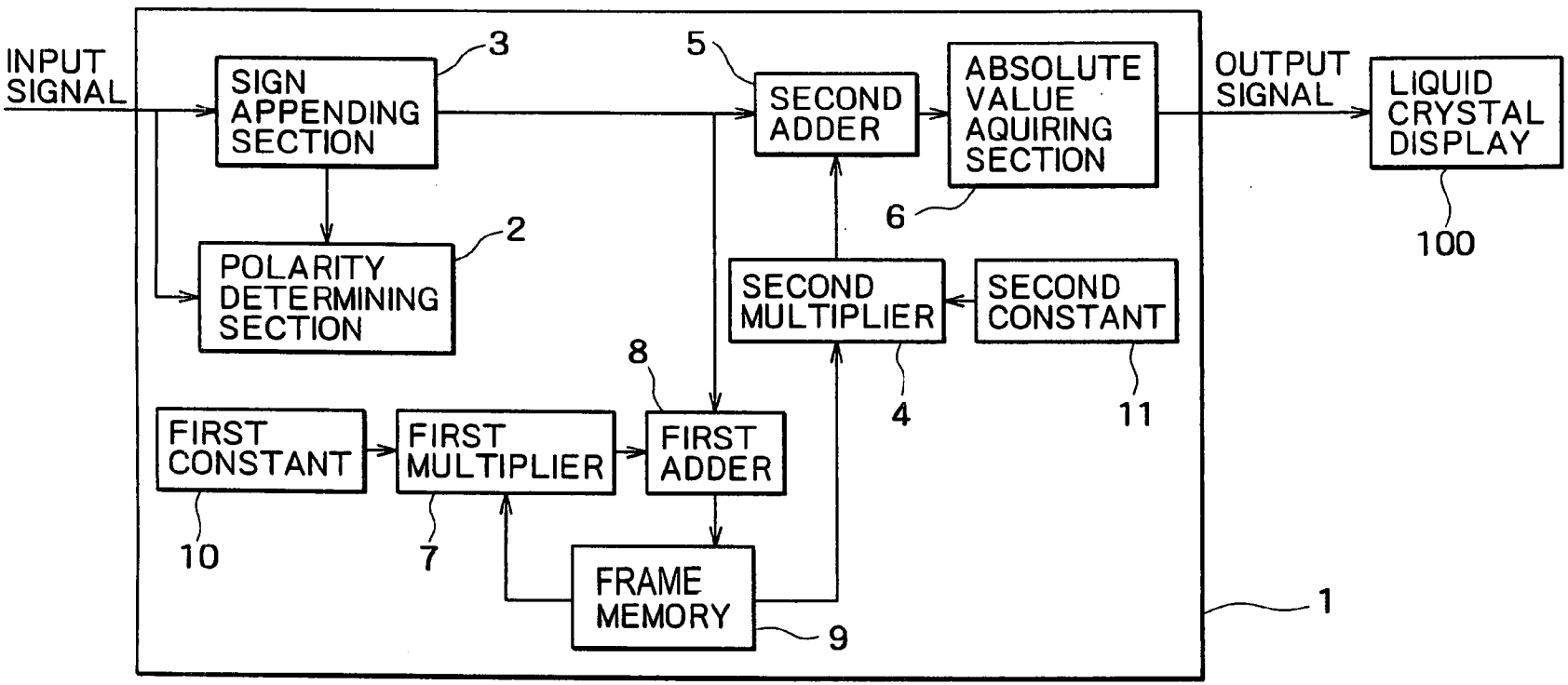
FIG. 3 is a block diagram showing a signal correcting circuit for a liquid crystal display according to one embodiment of the invention.

Preferred embodiments of the present invention will be described below with reference to the accompanying drawings. FIG. 3 is a block diagram showing a signal correcting circuit 1 for a liquid crystal display 100 according to an embodiment of the present invention. In the signal correcting circuit 1, a polarity determining section 2 determines from an input signal input from an external unit or the like whether a voltage applied to the liquid crystal has a positive polarity or a negative polarity. A sign appending section 3 appends a positive or negative signal to the input signal in accordance with a decision made by the polarity determining section 2. A frame memory 9 stores one frame of image data. A first multiplier 7 multiplies data stored in the frame memory 9 by a first constant 10. A first adder 8 adds a signal to which the positive or negative sign is appended by the sign appending section 3 to an output signal from the first multiplier 7 and outputs a resultant signal to the frame memory 9. A second multiplier 4 multiplies data stored in the frame memory 9 by a second constant 11. A second adder 5 adds an output signal from the sign appending section 3 to an output signal from the second multiplier 4. An absolute value acquiring section 6 removes a positive or negative sign from an output signal from the second adder 5 and outputs a resultant signal as an absolute value.

Figure 4:
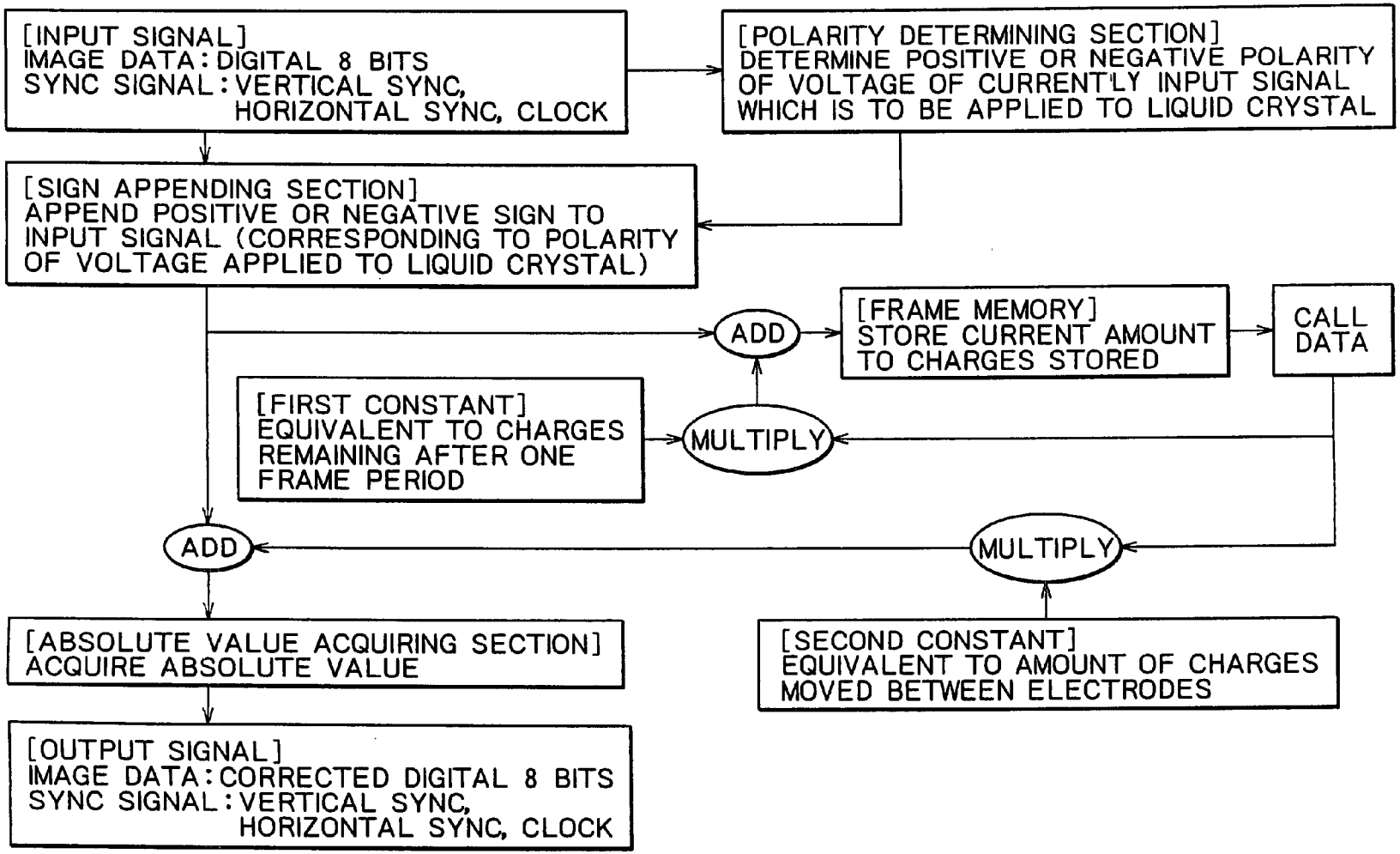
FIG. 4 is a flowchart illustrating the signal correcting circuit for the liquid crystal display according to the embodiment of the invention.

The operation of the embodiment will be discussed below. FIG. 4 is a flowchart illustrating the operation of the signal correcting circuit. An input signal, such as image data, input from an external unit or the like is sent to the sign appending section 3 as well as to the polarity determining section 2. The polarity determining section 2 counts the number of pulses of the input signal since the time the signal correcting circuit 1 is powered on. The polarity determining section 2 decides that the voltage applied to the liquid crystal has a positive polarity when the count is an even number or a negative polarity when the count is an odd number. The result of the decision is sent to the sign appending section 3 and a positive sign or negative sign is appended to the image data as the input signal. The second adder 5 adds the sign appended image data to the result of the multiplication done by the second multiplier 4 which will be discussed later. The result of the addition done by the second adder 5 is sent to the absolute value acquiring section 6 where the positive or negative sign is removed. An output signal from the absolute value acquiring section 6 is sent to the liquid crystal display as the output signal of the signal correcting circuit 1.

The frame memory 9 has an initial value of "0" stored beforehand at the timing of giving power or resetting the overall display. Image data acquired from the frame memory 9 is set to the first multiplier 7 and the second multiplier 4. The first multiplier 7 multiplies the image data by the predetermined first constant 10. The first adder 8 adds the result of the multiplication to the result of an operation done by the sign appending section 3. The result of the addition is stored again in the frame memory 9. The data that has been sent to the second multiplier 4 is multiplied by the predetermined second constant 11, and the result of the multiplication is sent to the second adder 5. The first constant 10 and the second constant 11 vary in accordance with the characteristics of the liquid crystal display, such as the cell parameters which include the specific resistance of the liquid crystal in the liquid crystal cell and the gap between the electrodes, and are set to optimal values that have been acquired beforehand through experiments.

Figure 5:
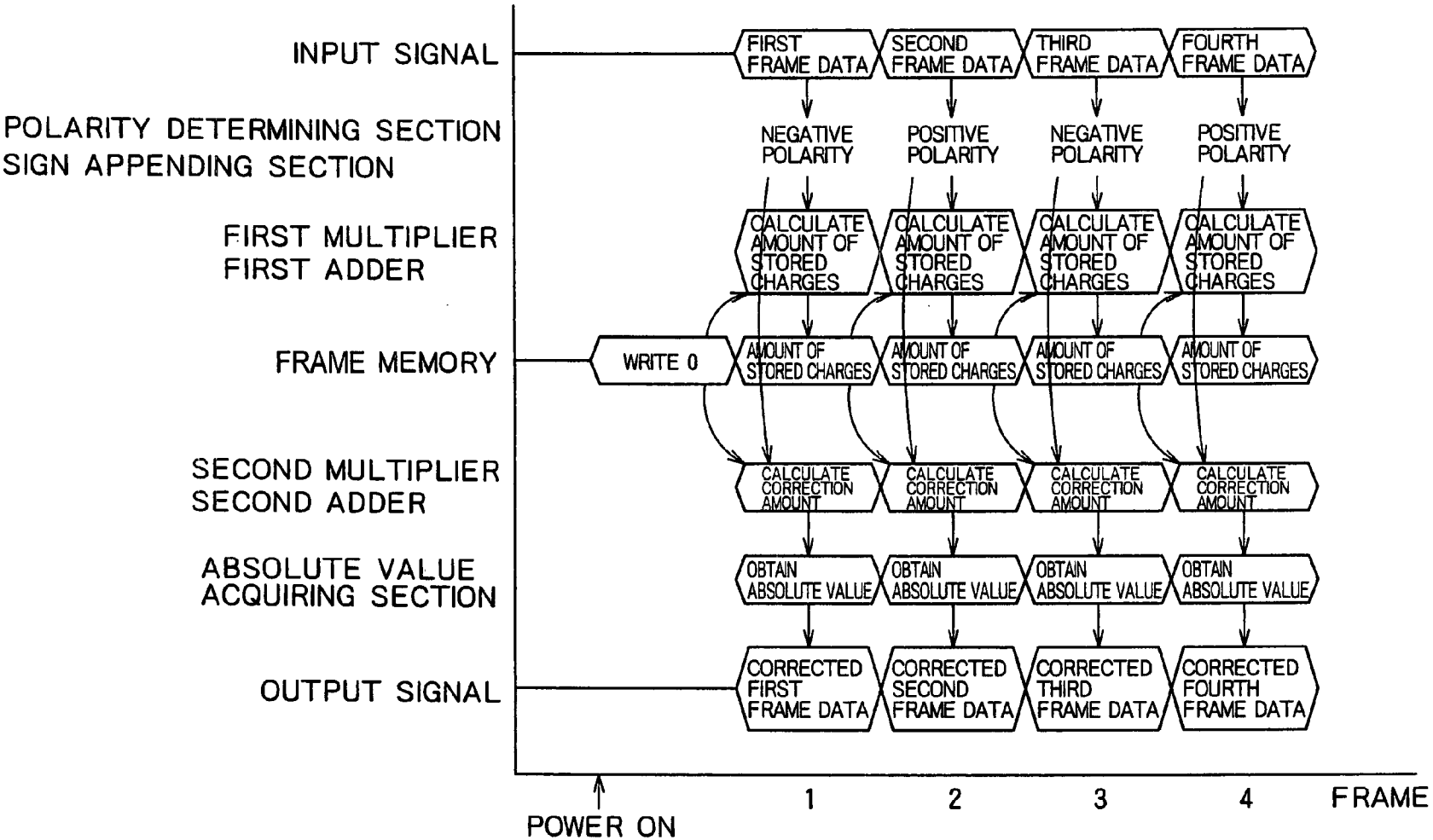
FIG. 5 is a timing chart of the signal correcting circuit for the liquid crystal display according to the embodiment of the invention.

A description will now be given of how to correct an image signal input to a single pixel by referring to a timing chart in FIG. 5. As shown in FIG. 5, the signal correcting circuit 1 according to the embodiment writes "0" in the frame memory 9 when powered on. As an input signal of the first frame (first frame data) is input, a positive or negative sign is appended to the input signal by the polarity determining section 2 and the sign appending section 3. Then, the input signal appended with the positive or negative sign is corrected by a correction amount, which is calculated from data in the frame memory 9, by the second multiplier 4 and the second adder 5. Because data in the frame memory 9 is "0" in the first frame, the correction amount is "0" and the input signal is sent as it is to the absolute value acquiring section 6. The absolute value acquiring section 6 removes the positive or negative sign from the input signal and outputs the resultant signal as the output signal of the signal correcting circuit 1. At the same time, the first multiplier 7 and the first adder 8 calculate the amount of charges stored in the electrode from the input signal appended with the positive or negative sign and data (0) in the frame memory 9. The result of the calculation is stored in the frame memory 9 to overwrite "0".

When second frame data is input thereafter, a positive or negative sign is appended to the input signal (second frame data) by the polarity determining section 2 and the sign appending section 3 as done for the first frame data. Then, the input signal appended with the positive or negative sign is corrected by a correction amount, which is calculated from data in the frame memory 9, by the second multiplier 4 and the second adder 5. Here, the data in the frame memory 9 is the value that has been stored at the time of processing the first frame data. The input signal that has been corrected by the second multiplier 4 and the second adder 5 is sent to the absolute value acquiring section 6 where the positive or negative sign is removed from the input signal and is output as the output signal of the signal correcting circuit 1. At the same time, the first multiplier 7 and the first adder 8 calculate the amount of charges stored from the input signal appended with the positive or negative sign and data in the frame memory 9, as done for the first frame data.

The result of the calculation is stored in the frame memory 9 to overwrite data that has already been stored. For other pixels, correction is likewise carried out for each frame and all the image signals that have been output frame by frame constitute a single screen.

The contents of the process of each component will be discussed below. As an electric field E is applied between a pixel electrode (potential VPI) and an opposing electrode (VCOM), the amount of charges QM that move in the liquid crystal during one frame period is acquired from the following equation 1 when this amount of charges is sufficiently small. The amount of charges QM is the amount of charges of a material which is added to lower the specific resistance of the liquid crystal.

$$QM=A\cdot E \tag{1}$$

where A is a constant.

Charges QT stored at the same time are scattered at a constant ratio in one frame period and charges QD alone remain. When the scattering amount is small, the amount of the residual charges QD is acquired from the following equation 2.

$$QD=B\cdot QT \tag{2}$$

where B is a constant.

Adding the equations 1 and 2 together yields the following equation 3.

$$QT(N+1)=B\cdot QT(N)+A\cdot E \tag{3}$$

where QT(N+1) indicates the amount of charges that have been moved from the pixel electrode to the opposing electrode and stored there when the N-th frame counted from the start begins. At the start time, such as the power-on time, the charges are sufficiently scattered and counting starts from the state of 0 charges, so that the amount of charges QT(1) at the start time becomes as given by the following equation 4.

$$QT(1)=0 \tag{4}$$

This scheme allows a reverse bias electric field associated with the amount of charges moved to be applied between the pixel electrode and the opposing electrode in the N-th frame in addition to the normal electric field which is proportional to a voltage (VPI−VCOM) that should originally be applied to the liquid crystal. Therefore, the electric field E between the pixel electrode and the opposing electrode is given by the following equation 5.

$$E=\alpha\cdot(VPI-VCOM)-\beta\cdot QT(N) \tag{5}$$

where α and β are constants.

An electric field EID which should originally be applied to the liquid crystal is proportional to the amount obtained by multiplying an image input signal VS(N) by a predetermined sign P which causes inversion frame by frame becomes as given by the following equation 6.

$$EID=\alpha\cdot VS(N)\cdot P \tag{6}$$

where P is +1 or −1 and α is a constant.

In consideration of the amount of charges stored, it is actually desirable to convert the signal to the output signal VS(N) that satisfies the relationship expressed by the following equation 7.

$$\alpha\cdot VS(N)\cdot P=\alpha\cdot VS'(N)\cdot P-\beta\cdot QT(N) \tag{7}$$

Rewriting the equation 7 yields the following equation 8 to obtain the output signal VS' (N).

$$VS'(N)=|VS(N)\cdot P+\beta\cdot QT(N)/\alpha| \tag{8}$$

Substituting the equation 3 into the equation 6 yields the following equation 9.

$$QT(N+1)=B\cdot QT(N)+A\cdot\alpha\cdot VS(N)\cdot P \tag{9}$$

Then, VM(N) is defined as given by the following equation 10.

$$VM(N))=QT(N)/(A\cdot\alpha) \tag{10}$$

Substituting the equation 10 into the equation 8 yields the following equation 11.

$$VS'(N)=|VS(N)\cdot P+A\cdot\beta\cdot VM(N)| \tag{11}$$

Substituting the equation 10 into the equation 9 yields the following equation 12.

$$QM(N+1)=B\cdot VM(N)+VS(N)\cdot P \tag{12}$$

VM(1) if obtained from the equations 10 and 4 becomes as given by the following equation 13.

$$VM(1)=0 \tag{13}$$

Applying the equations 11, 12 and 13 to the circuit in FIG. 3 brings about the following. First, the polarity determining section 2 determines whether a frame number N for the input signal VS(N) is an even number or odd number. The sign appending section 3 appends the sign P of +1 or −1 to the input signal VS(N) depending on whether the frame number N is an even number or odd number. The sign-appended input signal VS(N)·P is given to the second adder 5 which performs an operation equivalent to the equation 11. The second constant 11 in FIG. 3 is equivalent to A·β and VM(N) is a value to be stored in the frame memory 9. The result of the operation of the second adder 5 is sent to the absolute value acquiring section 6 where it is converted to an absolute value and output as such. Based on the output signal, the liquid crystal display is driven.

Meanwhile, the sign-appended input signal VS(N)·P is also supplied to the first adder 8 which performs an operation equivalent to the equation 12. The first constant 10 in FIG. 3 is equivalent to B and the result of the operation done by the first adder 8 is returned to the frame memory 9 and stored as VM(N+1).

A more detailed description of the operation will be given of one example where the first constant 10 is 0.98 and the second constant 11 is 0.02. In case where the first value of the input signal is positive and +5 is input on the positive side and 0 is input on the negative side in such a way that values are input in the order of "5, 0, 5, 0, 2, 2, 2, 2, 2, 2, . . . ", the movement of charges by the positive voltage is not canceled by the movement of charges by the negative voltage so that the residual electric field is generated until charges are moved from the pixel electrode to the opposing electrode and stored there and are scattered.

At this time, in the signal correcting circuit 1 shown in FIG. 3, large positive data (about 10) obtained from the equation 12 is stored in the frame memory 9 and the output value from the second multiplier 4 (hereinafter called "correction value") becomes 0.2 as acquired from A·β·VM(N) in the equation 11 at the time "5, 0, 5, 0" have been input. The input signal to which this correction value is added is output as an output signal which is applied to the liquid crystal display, thereby correcting the residual electric field.

Figure 6:
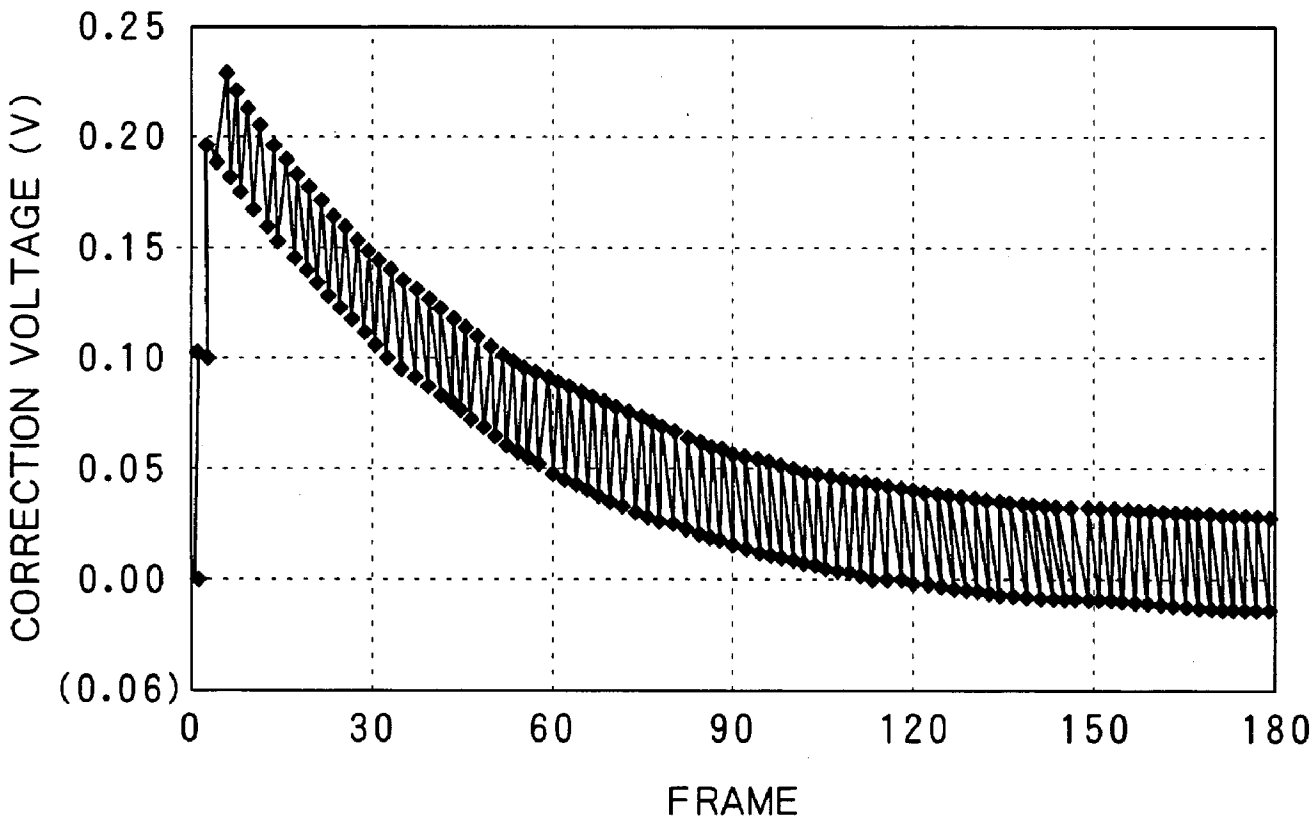
FIG. 6 is a diagram exemplifying a correction voltage which is applied frame by frame by the signal correcting circuit for the liquid crystal display of the invention.

As constant values, such as "2, 2, 2, 2, . . . ", are input, charges are scattered so that the correction amount is attenuated in accordance with the first constant 10. In this case, the correction amount approaches 0 in 180 frames (equivalent to about one second). If the input signal repeats such a state as "5, 0, 5, 0, 5, 0, . . . " over a relative time, the movement of charges achieved by application of 5 V in a positive frame is approximately balanced with the amount of charges that are to be scattered in a negative frame, so that the value VM(N) in the frame memory 9 fluctuates between two values. As the state "2, 2, 2, 2, . . . " is repeated from that fluctuating state, the correction amount is attenuated in accordance with the first constant 10 and becomes nearly 0 in 180 frames (equivalent to about three seconds). FIG. 6 shows the relationship between the frame number and the correction amount in this case.

By correcting the signal to be applied to the liquid crystal display in the above-described manner using the circuit illustrated in FIG. 3, it is possible to almost completely compensate for the influence on the low-resistant component in the liquid crystal that is caused by the DC component which is applied based on the asymmetry of the signal of the voltage applied between the pixel electrode and the opposing electrode in the liquid crystal display.

The foregoing description of in the embodiment has been given of the case where the first constant 10 is 0.98 and the second constant 11 is 0.02. Because the first constant 10 and the second constant 11 vary in accordance with the cell parameters, such as the specific resistance of the liquid crystal in the liquid crystal cell and the gap between the electrodes, however, when various parameters of the liquid crystal display section of the liquid crystal display are changed, the first constant 10 and the second constant 11 should be adjusted accordingly.

The liquid crystal display according to the embodiment is not limited to an IPS liquid crystal display which uses a low-resistant liquid crystal, but the invention can be adapted to other liquid crystal displays, such as a twisted nematic (TN) type liquid crystal display, by changing the first constant and the second constant.

Figure 7:
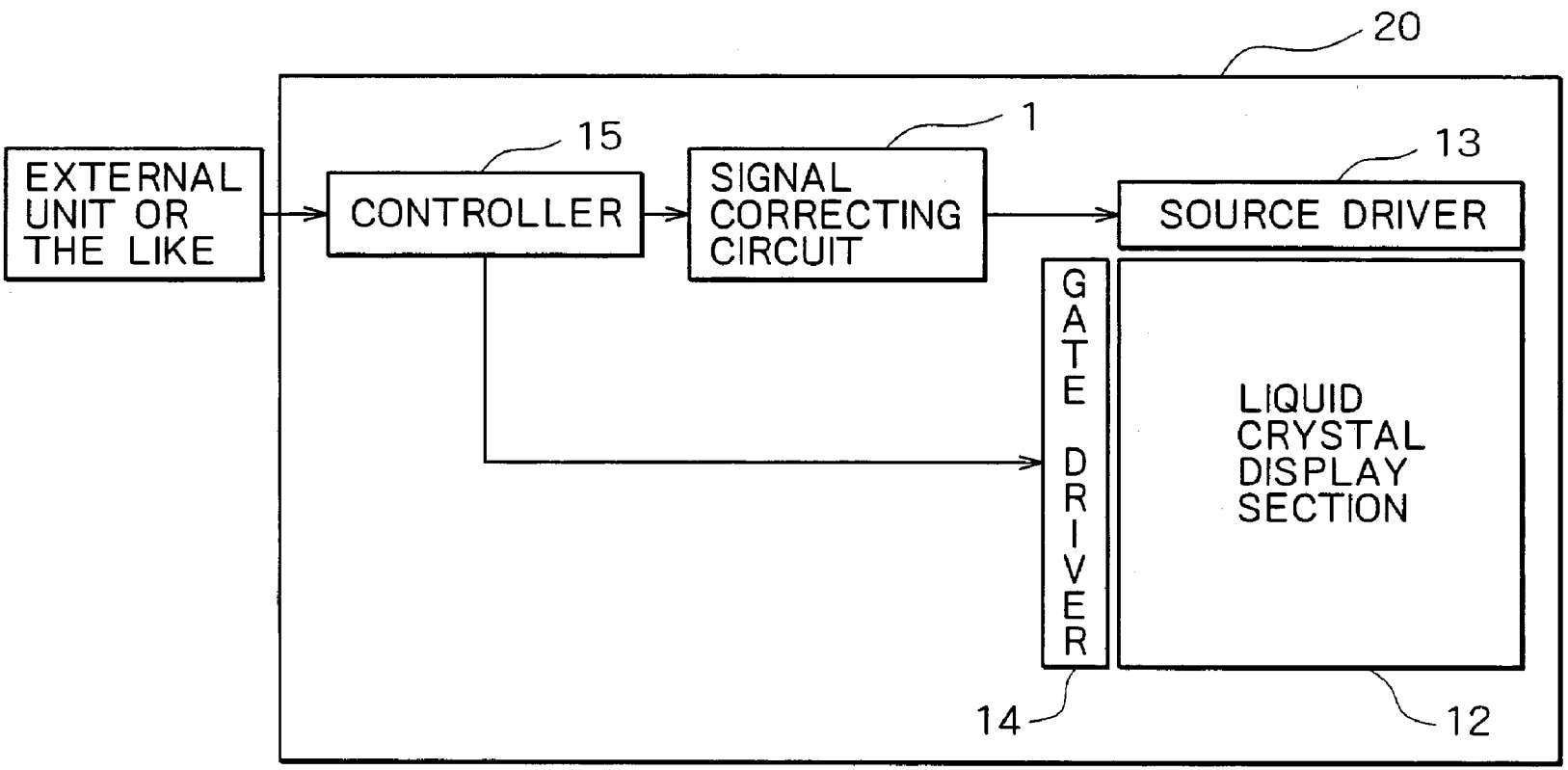
FIG. 7 is a block diagram showing the structure of a liquid crystal display according to another embodiment of the invention.

The liquid crystal display may be constructed in such a way that the output signal of the above-described signal correcting circuit is used as an input signal to the source driver of the liquid crystal display section which has display pixels laid out in a matrix form. The following will discuss a liquid crystal display 20 according to another embodiment of the invention. FIG. 7 is a block diagram showing the structure of the liquid crystal display. The liquid crystal display 20 has a liquid crystal display section 12 which has display pixels laid out in a matrix form. A controller 15 outputs image data and a horizontal sync signal based on an input signal supplied from an external unit. A source driver 13 supplies the image data output from the controller 15 to the individual pixels of the liquid crystal display section 12. A gate driver 14 sequentially enables the individual pixels in synchronism with the horizontal sync signal output from the controller 15. A signal correcting circuit 1 which has the same structure as the above-described signal correcting circuit 1 of the first embodiment is provided between the controller 15 and the source driver 13.

In the thus constituted liquid crystal display 20, the controller 15 converts the input signal input from the external unit to image data and the horizontal sync signal and outputs them. The image data output from the controller 15 is input to the signal correcting circuit 1 which in turn corrects the image data and sends the corrected image data to the source driver 13. The horizontal sync signal output from the controller 15 is input to the gate driver 14. The individual pixels of the liquid crystal display section 12 display the image data supplied from the source driver 13, based on the horizontal sync signal supplied from the gate driver 14. At this time, the image data is corrected by the signal correcting circuit 1 so that the liquid crystal display does not suffer residual images and flickering of the screen.

As described above, the use of the signal correcting circuit according to the invention in a liquid crystal display corrects image signals in such a way as to cancel out charges to be stored in the pixel electrode of the liquid crystal display panel. Even in case where, for example, an image with high contrast moves within the screen, therefore, concentrated generation of charges only on one side of the pixel electrode can be inhibited, thereby preventing display problems, such as generation of residual images and flickering of the screen.

What is claimed is:

1. A signal correcting circuit for a liquid crystal display, comprising:

a polarity determining section for determining from an input signal whether a voltage applied to a liquid crystal has a positive polarity or a negative polarity;

a sign appending section for appending a positive or negative signal to said input signal in accordance with a decision made by said polarity determining section;

a frame memory;

a first multiplier for multiplying data stored in said frame memory by a first constant;

a first adder for adding a signal to which said positive or negative sign is appended by said sign appending section to an output signal from said first multiplier and outputting a resultant signal to said frame memory;

a second multiplier for multiplying data stored in said frame memory by a second constant;

a second adder for adding an output signal from said sign appending section to an output signal from said second multiplier; and an absolute value acquiring section for removing a positive or negative sign from an output signal from said second adder and outputting a resultant signal as an absolute value.

2. The signal correcting circuit according to claim 1, wherein said liquid crystal display is an in-plane switching liquid crystal display which uses a low-resistant liquid crystal.

3. The signal correcting circuit according to claim 1, wherein said first constant is a ratio at which charges stored in said liquid crystal display remain after one frame period.

4. The signal correcting circuit according to claim 1, wherein said second constant is an amount of charges moved between electrodes.

5. A liquid crystal display that uses an output signal from an absolute value acquiring section of a signal correcting circuit as input signal to a liquid crystal display section having display pixels laid out in a matrix form, said signal correcting circuit comprising:

a polarity determining section for determining from an input signal whether a voltage applied to a liquid crystal has a positive polarity or a negative polarity;

a sign appending section for appending a positive or negative signal to said input signal in accordance with a decision made by said polarity determining section;

a frame memory;

a first multiplier for multiplying data stored in said frame memory by a first constant;

a first adder for adding a signal to which said positive or negative sign is appended by said sign appending section to an output signal from said first multiplier and outputting a resultant signal to said frame memory;

a second multiplier for multiplying data stored in said frame memory by a second constant;

a second adder for adding an output signal from said sign appending section to an output signal from said second multiplier; and said absolute value acquiring section for removing a positive or negative sign from an output signal from said second adder and outputting a resultant signal as an absolute value.

6. The liquid crystal display according to claim 5, further comprising:

a controller for outputting image data and a horizontal sync signal based on an input signal externally supplied;

a source driver for supplying said image data output from said controller to said liquid crystal display section; and a gate driver for sequentially enabling said display pixels of said liquid crystal display section in synchronism with said horizontal sync signal output from said controller; wherein said signal correcting circuit is provided between said controller and said source driver for correcting said image data.

* * * * *